US007477248B2

(12) United States Patent
Johnson

(10) Patent No.: US 7,477,248 B2
(45) Date of Patent: Jan. 13, 2009

(54) DISPLAY DEVICE, ELECTRIC DEVICE COMPRISING SUCH A DISPLAY DEVICE AND METHOD FOR DRIVING A DISPLAY DEVICE

(75) Inventor: Mark Thomas Johnson, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 621 days.

(21) Appl. No.: 10/534,805

(22) PCT Filed: Oct. 27, 2003

(86) PCT No.: PCT/IB03/04770

§ 371 (c)(1),
(2), (4) Date: May 12, 2005

(87) PCT Pub. No.: WO2004/047061

PCT Pub. Date: Jun. 3, 2004

(65) Prior Publication Data

US 2006/0022899 A1 Feb. 2, 2006

(30) Foreign Application Priority Data

Nov. 15, 2002 (EP) ..... 02079767

(51) Int. Cl.
*G09G 5/00* (2006.01)
*G09G 5/10* (2006.01)
*G09G 3/32* (2006.01)

(52) U.S. Cl. ..... 345/214; 345/76; 345/77; 345/82; 345/204; 345/690

(58) Field of Classification Search ..... 345/1.1, 345/1.2, 55, 76, 77, 79, 82, 156, 184, 204, 345/214
See application file for complete search history.

(56) References Cited

U.S. PATENT DOCUMENTS

| | | | | |
|---|---|---|---|---|
| 6,020,865 | A * | 2/2000 | Okuda et al. | 345/82 |
| 6,023,259 | A | 2/2000 | Howard et al. | |
| 6,985,163 | B2 * | 1/2006 | Riddle et al. | 345/690 |
| 7,012,588 | B2 * | 3/2006 | Siwinski | 345/83 |
| 7,212,193 | B2 * | 5/2007 | Ueda | 345/204 |
| 7,283,104 | B2 * | 10/2007 | Kim et al. | 345/9 |
| 2002/0084463 | A1 | 7/2002 | Sanford et al. | |
| 2003/0034985 | A1 * | 2/2003 | Riddle et al. | 345/589 |

FOREIGN PATENT DOCUMENTS

| | | | |
|---|---|---|---|
| DE | 4427673 | A1 | 2/1995 |
| EP | 1197944 | A2 | 4/2002 |
| EP | 1197944 | A3 | 3/2003 |
| WO | WO9953472 | A1 | 10/1999 |
| WO | WO 02/27700 | A2 | 4/2002 |

* cited by examiner

*Primary Examiner*—My-Chau T Tran
(74) *Attorney, Agent, or Firm*—Michael E. Belk

(57) ABSTRACT

The invention relates to a display device and a method of driving a display device, wherein the display comprises a plurality of light emitting elements and means for applying a driving signal to the light emitting elements. The display device comprises control means for adjusting a duty cycle and a magnitude of the driving signal for at least one of the light emitting elements. In this way the uniformity of the display can be controlled while keeping the brightness of the display constant. Control of the uniformity of the display may e.g. be used in relation to control of the power consumption of the display device or improving the quality of dark images.

13 Claims, 4 Drawing Sheets

DISPLAY DEVICE, ELECTRIC DEVICE COMPRISING SUCH A DISPLAY DEVICE AND METHOD FOR DRIVING A DISPLAY DEVICE

The invention relates to a display device comprising a display having a plurality of light emitting elements and means for applying a driving signal to said light emitting elements.

Display devices employing light emitting elements on or over a substrate are becoming increasingly popular. These light emitting elements may be light emitting diodes (LED's), incorporated in or forming display pixels that are arranged in a matrix of rows and columns. The materials employed in such LED's are suitable to generate light if a current is conveyed through these materials, such as particular polymeric (PLED) or organic (OLED) materials. Accordingly the LED's have to be arranged such that a flow of current can be driven through these light emitting materials. Typically passively and actively driven matrix display are distinguished. For active matrix displays, the display pixels themselves comprise active circuitry such as one or more transistors.

In the usual manner of driving an active matrix display, all pixels emit light continuously when addressed. This state is referred to as a 100% duty cycle, wherein the duty cycle is defined as the percentage of time during which the display, or a light emitting element thereof, provides light in a frame period. This method of driving has the disadvantage that a low average current passes the drive transistors of the display pixels, which has a negative effect on the display uniformity. Uniformity is defined as the variation in brightness level between the different light emitting elements when driven with a driving current of equal magnitude. In addition, the display suffers from sample/hold effects that may blur e.g. video images. Sample/hold effects arise from the fact that in every frame period, a new image may be displayed at the start of the frame period (sample), whilst in remainder of the frame period (typically 16 msec for 60 Hz operation) the image remains visible on the screen (hold). For moving video images, the eye tries to follow the image across the display, whilst, due to the sample/hold nature of the addressing, the image is physically stationary. The user interprets this effect as a blurred image.

A method for avoiding these problems is to drive the active matrix display in a pulsed mode, wherein the display or the light emitting elements only emit light for a fraction of the time in the frame period, i.e. a reduced duty cycle. However, such an active matrix display, driven in a pulsed mode, gives rise to an increase in power consumption.

It is an object of the invention to provide an improved display device eliminating or reducing at least one of the above-mentioned disadvantages.

This object is achieved by employing a display device where control means are provided adapted to adjust a duty cycle and a magnitude of said driving signal for at least one of said light emitting elements. By adapting the duty cycle and in accordance therewith the magnitude of the driving signal or vice versa, the uniformity of the display or display pixels can be adjusted. It is noted that generally the product of duty cycle for and current conveyed by the light emitting element is substantially constant, as a result of which the variation of the brightness levels at a particular driving signal between different light emitting elements can be adjusted, while maintaining the average perceived brightness of the light emitting pixels at the original level.

In an embodiment of the invention the control means are adapted to select a single mode out of a plurality of available modes with respect to the uniformity of the display or display pixels. One advantage is that in choosing a particular mode with respect to the uniformity, the power consumption of the display device can be influenced. Another advantage relates to the flexibility in adapting the quality of the image on the display.

In an embodiment of the invention the display device comprises selection means for selecting one of the available modes by a user. The user of the display device may adapt the uniformity of the image if he so desires.

In an embodiment of the invention the single mode with respect to uniformity is selected in accordance with the power available or remaining for an electric device comprising the display device. An advantage of this embodiment is that the display device may automatically switch to a lower uniformity for the display, if the power for the device falls below a certain level, thereby increasing the time during which the display device can be used.

In a preferred embodiment of the invention the single mode is selected in response to the data to be displayed on the display and/or received by said display device or electric device. This provides the possibility that the uniformity of the display is automatically adjusted depending on whether the display is actively used or in a so-called stand by mode. Moreover the uniformity of the display and/or the power consumption can be adjusted automatically if the data to be displayed gives rise to such an adjustment, e.g. if the image to be displayed is on average dark. In addition the number of grey levels, i.e. visible brightness levels is dynamically increased if uniformity is increased and the duty cycle is reduced for such dark images.

In a preferred embodiment the single mode is selected in accordance with the rate of change of the data to be displayed on the display. This provides the advantage that for moving images to be displayed, the uniformity can be increased automatically by increasing the grey level. In addition sample/hold artefacts may be avoided in this embodiment, since a shorter duty cycle, which reduces the hold period, results in a perceived sharper image of moving objects.

It should be clear that for the embodiments presented above that the single mode may be selected by the user or automatically and dynamically from the available modes. As a result the functionality of the display device is enhanced.

In the embodiments discussed above, it was assumed that the entire display operated in the same mode, i.e. the same uniformity for the entire display. However, in a preferred embodiment the display comprises at least a first part displayed in a first mode of said available modes and a second part displayed in a second mode of said available modes. This has the advantage that if e.g. different images are to be displayed on different parts on the display, different modes with respect to uniformity can be employed.

It should be appreciated that the embodiments, or aspects thereof, may be combined.

The invention further relates to an electric device comprising a display device as described in the previous paragraphs. Such an electric device may relate to handheld devices such as a mobile phone, a Personal Digital Assistant (PDA) or a portable computer as well as to devices such as a Personal Computer, a television set or a display on e.g. a dashboard of a car. It is noted that the issue of power consumption is particularly relevant for battery powered devices.

The invention further relates to a method for driving a display by a driving signal, said display having a plurality of light emitting elements comprising the step of adjusting a duty cycle and magnitude of said driving signal in accordance with each other for at least one of said light emitting elements.

It is noted that this method is not only applicable to PLED or OLED devices, but more generally to devices wherein the light intensity is defined by the current delivered by a driving transistor of which the characteristics may vary from one transistor to another. Examples include electroluminescent display devices, active matrix display devices bases on field emission techniques and electrochromic or switching mirror type of display devices.

It is noted that WO 02/27700 discloses a display device comprising a driver circuit which modulates the duty cycle of the on-state of a pixel during a frame period. However, in this publication the duty cycle is adjusted in order to obtain a particular pixel brightness using pulse width modulation, without changing the magnitude of the driving signal. Uniformity of the display is not an issue in this publication.

U.S. 2002/084463 discloses a CMOS driving circuit for an OLED display, wherein the luminance is controlled by application of a duty factor. Again the driving is performed by digital pulse width modulation, so no means for changing the brightness of the pixels are disclosed. In addition, for CMOS driven display devices uniformity of the display is generally not an issue, in contrast to display devices applying polysilicon (p-Si) or amorphous-silicon (a-Si) driving transistors of which the characteristics may vary considerably from one transistor to another. Standard CMOS-drivers are usually applied for micro-displays and cannot easily handle high voltages.

The invention will be further illustrated with reference to the attached drawing, which shows preferred embodiments according to the invention. It will be understood that the device and method according to the invention are not in any way restricted to this specific and preferred embodiment.

Figure 3A:
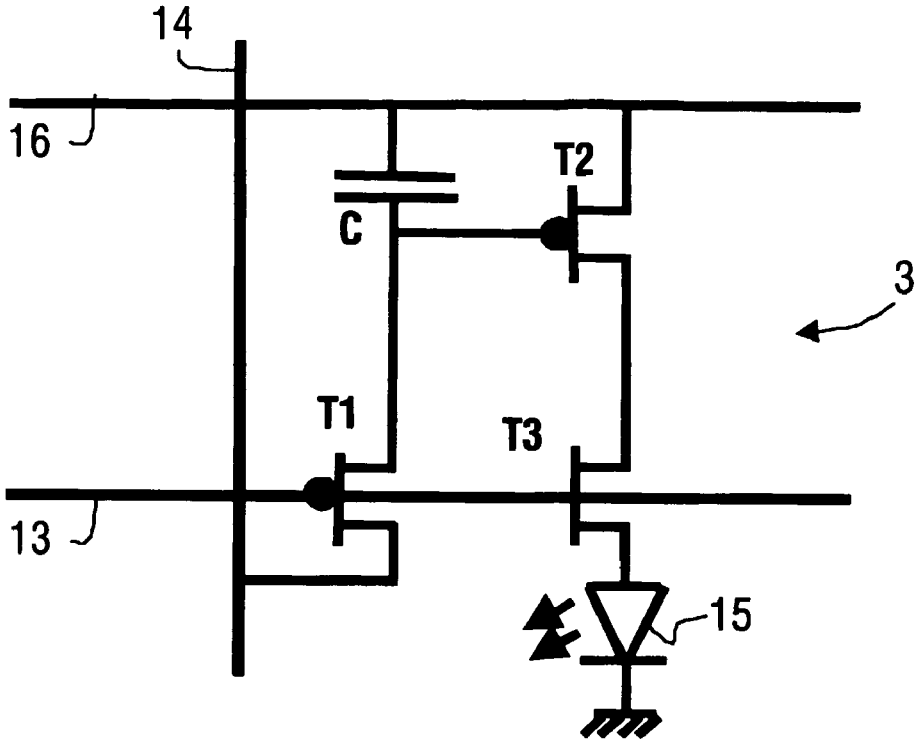
Figure 4A:
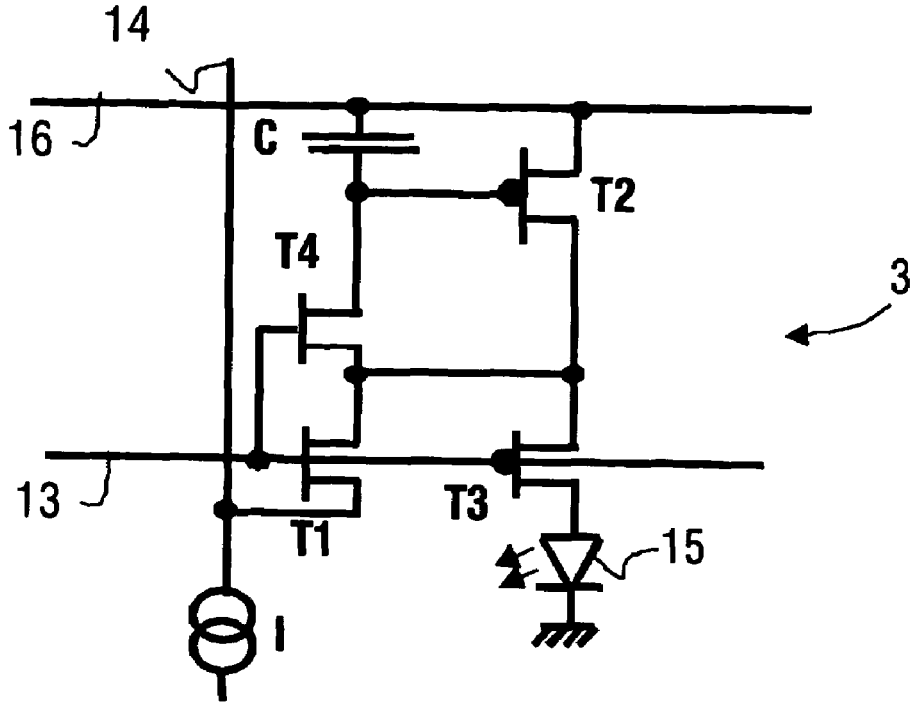
Figure 5:
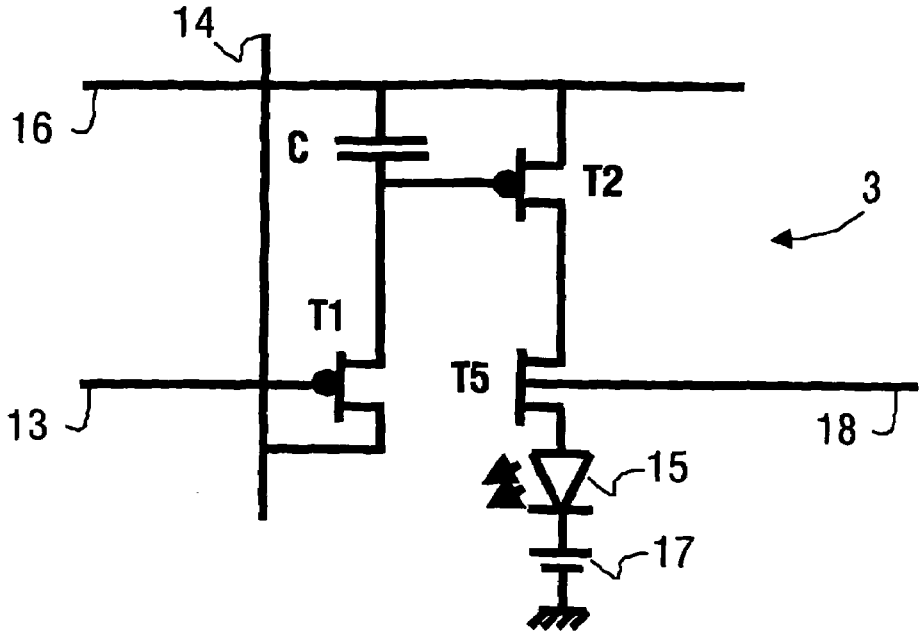
Figure 6:
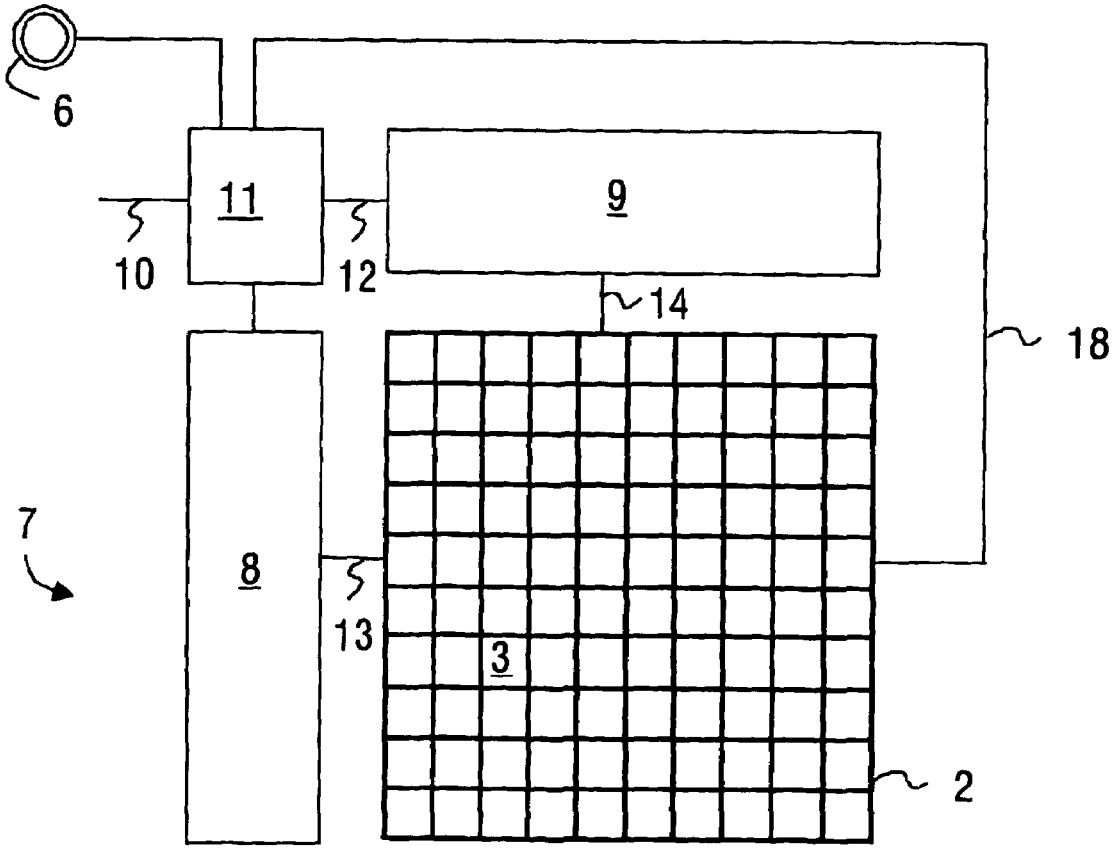

FIGS. 3A and B show an embodiment of a display pixel for a voltage addressed active matrix display and the behaviour of the brightness variation at various grey levels for the display pixels;

FIGS. 4A and B show an embodiment of a display pixel for a current addressed active matrix display and the behaviour of the brightness variation at various grey levels for the display pixels;

FIG. 5 shows an embodiment of a display pixel for an active matrix display illustrating various alternatives for adjusting the duty cycle of the display pixel;

FIG. 6 shows a second arrangement for an active matrix display according to an embodiment of the invention.

Figure 1:
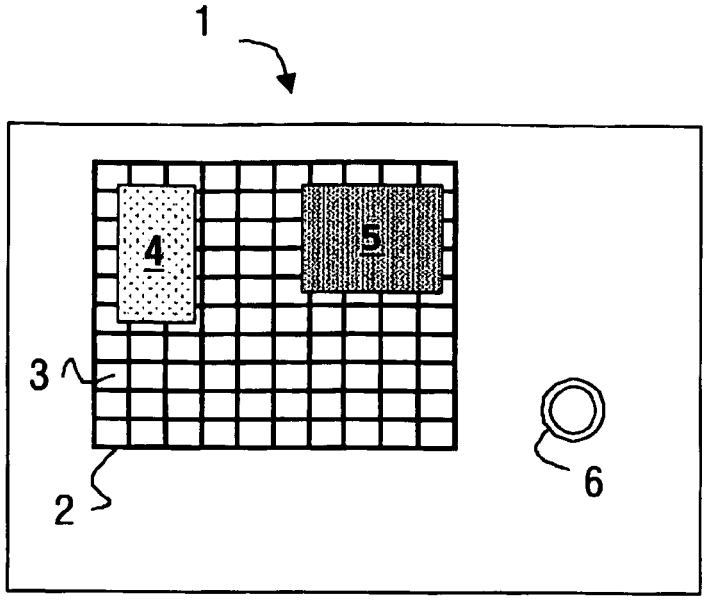
FIG. 1 shows an electric device according to an embodiment of the invention.

FIG. 1 shows an electric device 1 comprising a display 2 having a plurality of display pixels 3 arranged in a matrix of rows and columns. Display 2 may comprise one or more parts 4, 5 that appear on the display 2 as windows or pop-up screens for displaying different kinds or types of information or data compared to the main display 2. Part 4 may e.g. show a menu facility that is prompted via a remote control (not shown). The menu facility may provide the user of the device 1 with options of adjusting e.g. the brightness and/or the contrast of the display 2. According to an embodiment of the invention this menu facility may also include an option for adjusting the uniformity of the display 2 or display pixels 3 or display part 5. Alternatively or in addition the electric device 1 may comprise a control dial or button 6 that may be employed by the user to adjust the uniformity of the display 2 or display parts 4, 5. The display parts 4, 5 of different uniformity may be present or called by the user in a single display. The multiple uniformities in one display 2 can be achieved by operating the various parts 4, 5 of the display 2 at different duty cycles. It should be appreciated that the remainder of the display 2 may operate in a third mode having a different uniformity than parts 4, 5. Examples of such applications include windows in multimedia applications or picture-in-picture (PIP) for television screens, wherein e.g. video image sections are subject to a lower duty cycle, while stationary image sections operate at a higher duty cycle. Another example relates to mobile phones, wherein a first part 4 of the display 2 may be in a stand-by state and a second part 5 of the display 2 is actively used. It is noted that in general the parts 4, 5 of the display 2 operating in a particular single mode do not have to be predefined, but may vary in location on the display 2 from frame to frame as defined by the control means (see FIG. 2).

Figure 2:
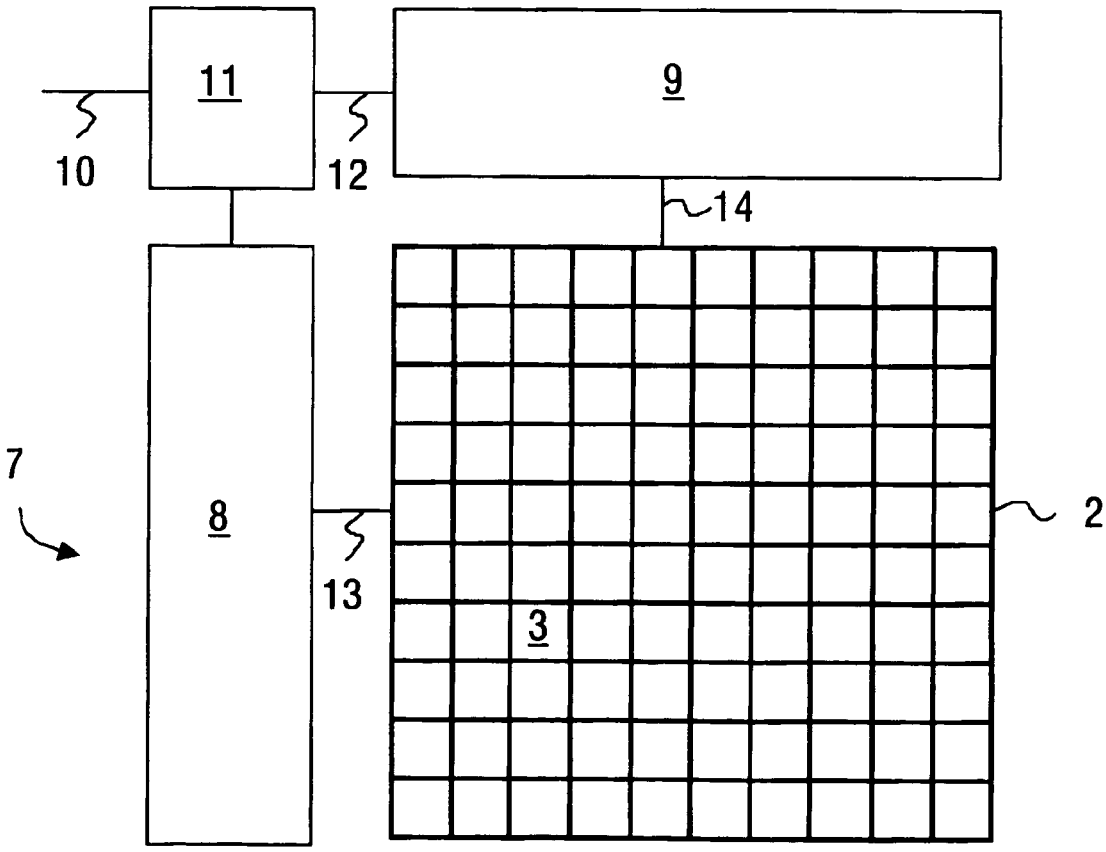
FIG. 2 shows a first arrangement for an active matrix display according to an embodiment of the invention.

FIG. 2 shows a display device 7, comprising the display 2 of the electric device 1 as shown in FIG. 1. The display 2 comprises a row selection circuit 8 and a data register 9. Information or data, such as (video)images, received via line 10 and to be presented on the display 2 is input to the control unit 11 which information or data is subsequently transmitted by the control unit 11 to the appropriate parts of the data register 9 via line 12. The selection of the rows of display pixels 3 is performed by the row selection circuit 8 via line 13. Data are written to the display pixels 3 from the data register 9 via line 14.

FIG. 3A shows a known arrangement for a display pixel 3 comprising an addressing transistor T1, a storage capacitor C and means T2 for applying a driving signal to a light emitting element 15. T2 may be a p-Si thin film transistor (TFT) and light emitting element 15 may be a light emitting diode, such as a PLED or an OLED. One of the plates of the capacitor C and the source electrode of T2 are connected to a voltage supply line 16.

If T2 is biased in saturation it behaves as a constant current source, passing a current which is proportional to $\mu_{fe}$. $(V_{GS}-V_T)^2$ where $V_{GS}$ is the gate-source voltage of T2, $V_T$ the threshold voltage, and life is the field effect mobility of T2. This constant current is then driven through the LED 15 which is connected to T2. Thus, the current source is programmed by setting the voltage on the gate of T2. This is achieved during a short addressing time of e.g. 25 μs by turning on T1 via line 13 and transferring the signal voltage from the data register 9 to the gate of T2. T1 is then switched off, and the programmed voltage is held on the gate of T2 for the rest of the frame time. The storage capacitor C prevents appreciable discharge of this node via leakage through T1, thus forming a memory to allow continuous LED current while the other rows of the display 2 are selected sequentially. This addressing scheme works well, but requires very high uniformity in the characteristics of T2 for substantially each display pixel 3 in the display 2, since the current is proportional both to $(V_{GS}-V_T)^2$ and to $\mu_{fe}$. The circuit is also prone to some second order horizontal cross-talk effects. These arise because there is a current flowing through T2 and the LED 15 during the addressing period, and because the current carrying row electrodes have a finite resistance. Thus, there are voltage drops along the current carrying row, the source voltage of T2 is no longer well defined, and so the values of $V_{GS}$ are in error. In the arrangement shown in FIG. 3A, an n-channel transistor (T3) is added in series with the current source T2 and the PLED 15. This transistor T3 switches off the current flow during the addressing period, which reduces the voltage programming error described above.

Figure 3B:
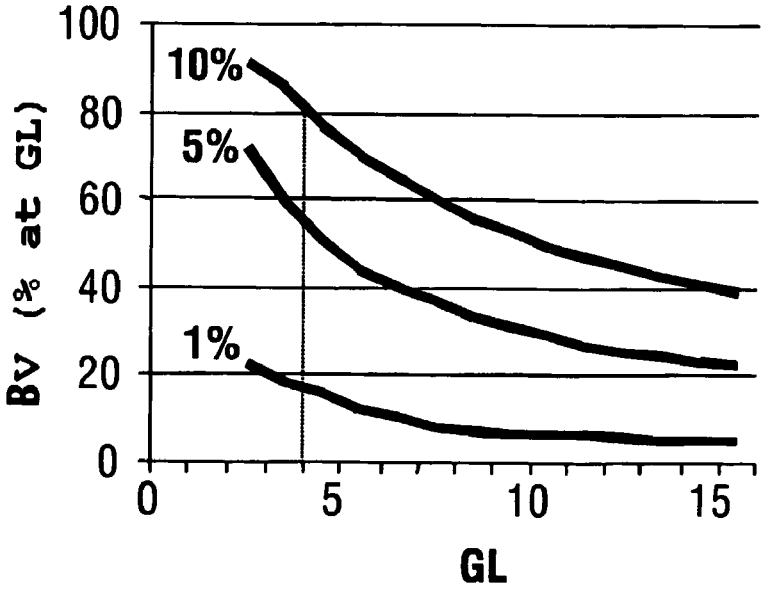

For drive transistors T2, variations for $\mu_{fe}$ and $V_T$ in the range of 5-10% are typically observed. FIG. 3B shows a simulation result for a display 2 comprising display pixels 3 as depicted in FIG. 3A, wherein the behavior of the brightness variation BV between different display pixels 3 as a percentage of the grey level GL was obtained for various grey levels of the LED 15. Grey level or brightness level is a measure for the amount of current conveyed by the LED 15, however, not necessarily in a linear relation. It is clear from the simulation result presented in FIG. 3B that a significant variation of the brightness between different display pixels 3 may arise, especially for variations for $\mu_{fe}$ and $V_T$ in the range of 5-10%. As an example at a grey level of 4, which corresponds with a particular current magnitude, the brightness of a LED 15 may be 80% higher than for an adjacent LED 15, while driven with the same current magnitude, (see dashed line presumed that the characteristics of the drive transistors T2 for the LEDs 15 vary in the range of 10%. It is noted that the brightness variation BV between different display pixels 3 decreases with increasing grey level, i.e. if the LEDs 15 convey higher currents, i.e. higher magnitude of the driving signal.

A current mirror pixel circuit as shown in FIG. 4A may reduce the effects resulting from the variation in the characteristics for T2, while still operating in an analogue mode. The driving transistor T2 is used in both addressing the display pixel 3 and in driving the LED 15. The data input signal is applied as a current rather than a voltage over the line 14, indicated by the current source I. During the addressing period the driving transistor T2 is diode-connected by the transistor T4 via addressing transistor T1, and the LED 15 is isolated from the circuit by the transistor T3. During this addressing period the data input current is forced through T2 while the capacitor C is charged to reach the associated gate-source voltage $V_{GS}$ for T2. Now, by opening T1 and T4 and by closing T3, the drain current is fed to the LED 15. The memory function of the capacitor C assures the LED current to be a perfect copy of the data input current received over line 14.

Figure 4B:
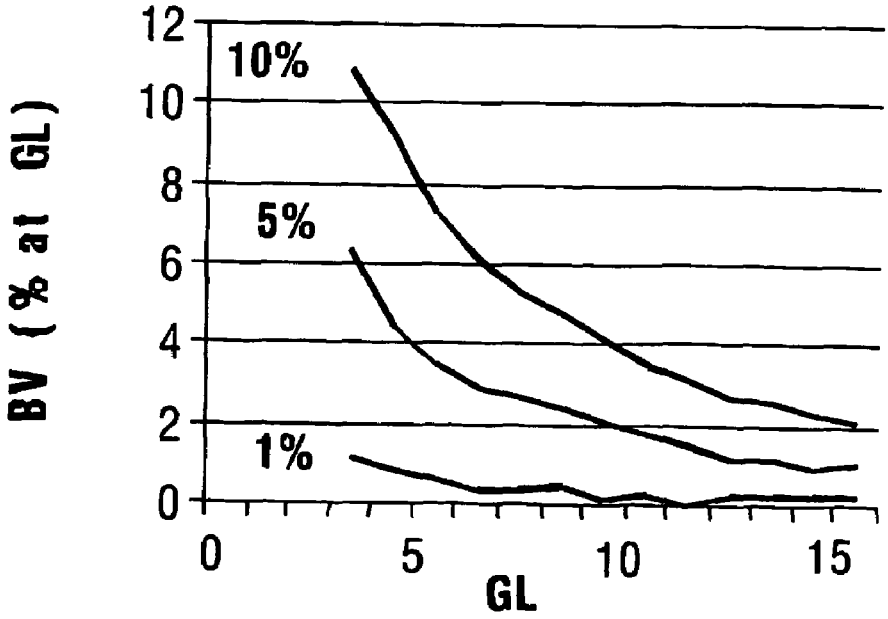

This description corresponds to an ideal circuit operation for the display pixel 3 as shown in FIG. 4A. In practice, issues e.g. relating to differences between the driving transistor T2 drain-source voltage during addressing and driving will give rise to errors, such that the driving current still has some dependency on the characteristics of the individual transistor T2 and LED 15. However, this dependency turns out to be much smaller than in the case of the current source pixel circuit. The main advantage of the current mirror circuit is the reduced influence of $V_T$ and $\mu_{fe}$ spread. FIG. 4B shows the calculated brightness variation. Compared to FIG. 3B, approximately one order of magnitude improvement in the brightness variation BV over the display 2 is observed, however display pixels 3 conveying higher currents still are more uniform in brightness.

It is the gist of the invention that use is made of the observed behaviour of the brightness variation BV with the grey value GL of a light emitting element 15. By adjusting the magnitude of the driving signal, a mode with respect to a desired or adequate uniformity can be selected corresponding to a point on the curves of FIG. 3B or FIG. 4B. In fact the curves represent available modes with respect to uniformity, out of which one or more single modes can be selected or are selected that are appropriate for the situation. It is noted that the driving signal may be a current with a particular magnitude, as discussed above, but may also be a voltage signal of a certain magnitude giving rise to a current with a magnitude determined by the light emitting element itself. This voltage signal is e.g. achieved if T2 acts as an open switch. By adjusting the duty cycle in accordance with the magnitude of the current conveyed by the light emitting elements, e.g. power consumption and image quality can be controlled manually or automatically.

FIG. 5 shows several ways in which the duty cycle can be adjusted for a voltage addressed active matrix driving scheme. One way to adjust the duty cycle is by applying an appropriate reverse voltage for a certain percentage of time of the frame period for the LED 15 of the display pixel 3, indicated by the voltage source 17. If the voltage source 17 prevents current to be conveyed by the LED 15 for e.g. 20% of the frame period a duty cycle of 80% is obtained. By setting the appropriate time during which the reverse voltage is applied by the voltage source 17 to e.g. all the display pixels 3 of the display 2, the required duty cycle can be obtained for the entire display 2. In a similar manner, the power line voltage 16 can be made adjustable to define the duty cycle.

Alternatively a switch T5, such as a power transistor, can be applied preventing that current is conveyed by the LED 15. The switch T5 can be addressed over a duty cycle select line 18 that is controlled by the control unit 11. By appropriate addressing of the duty cycle via the control unit 11, different duty cycles can be obtained for different parts 4, 5 of the display 2.

In yet another alternative additional addressing pulses can be incorporated into a frame period (e.g. the display 2 may be addressed two or more times during a frame instead of once). In this way, sub-frames are created. By addressing the display 2, or parts 4, 5 of the display 2, with a grey level associated with a black pixel for some of the sub-frames it is possible to adjust the duty cycle for the display 2.

It is noted that various other ways of adjusting the duty cycle are known. The invention does not rely on the way in which the duty cycle can be varied.

The selection of a mode with respect to the uniformity of the display 2 may be performed by (automatically) adjusting the duty cycle of the display 2. If e.g. the duty cycle is decreased, the magnitude of the driving signal, i.e. the current for the display pixel 3, may be increased automatically by the control means 11 such that the perceived average brightness of the display 2 or display pixels 3 remains constant. The increase in the magnitude of the current has two effects. A shift on the curves to a higher grey level as illustrated in FIGS. 3B and 4B is obtained, as a result of which the uniformity of the display 2 is increased. Moreover, since the current magnitude is increased the power consumption for the LED 15 generally increases as well. By this mechanism, a display 2 with e.g. two available modes can be envisaged, one mode relating to low power consumption and low uniformity for the display and the other mode relating to high power consumption and high uniformity for the display. In general a duty cycle that can be continuously adjusted in the range of e.g. 1-100% will result in an unlimited number of available modes which trade off uniformity for power. These modes can be chosen by the user in several ways, some of which were already discussed for FIG. 1.

With regard to the relation between uniformity of the display 2 and the power consumption, a display device 7 may e.g. operate by default in the high uniformity mode, corresponding to a low duty cycle and high power consumption. However, if the battery power falls below a certain level, that may be user defined, the display device 7 may switch, e.g. initiated by the control means 11, to a low uniformity mode, as a result of which power consumption is reduced. This has the advantage that the display device 7, especially when implemented in a battery powered electric device 1, may be used for a longer period before the device 1 is out of power.

The uniformity mode may alternatively or in addition relate to the operation state of the display 2. If the display 2 is e.g. in a standby state, the uniformity of the display 2 may be low as a result of which power consumption is reduced. If the display 2 switches to an active state, the display device may switch to another single mode relating to an increased uniformity for the display 2, by decreasing the duty cycle and increasing the current thought the light emitting elements, if the control means 11 is triggered with respect to the active state of the display 2.

The mode for the uniformity of the display 2 may be automatically selected in response to the type or content of the data, received by the control means 11 over line 10. If the image to be displayed is on average bright, it may be preferred to have a mode selected by the control means 11, wherein the duty cycle is increased, as the display 2 has already a reasonable uniformity. As a result power can be saved if such data are presented. However, if the image to be displayed is on average dark, a mode may be preferred wherein the uniformity of the display 2 is increased. This mode is selected by reducing the duty cycle and increasing the magnitude of the driving signal, e.g. by the control means 11. In this way, the duty cycle also dynamically adjusts the average brightness of the image. In addition, this reduced duty cycle increases the number of grey levels which can be made visible in the dark image, whilst maintaining the average brightness of the image to be displayed. If e.g. the duty cycle is decreased to 10%, the invention allows dividing the range of perceived brightness levels for the dark image in ten times smaller sections, if data containing these extra brightness levels is available. In this way more grey levels can be created in the dark image, thus the quality of the image can be significantly improved. In addition the selected single mode may relate to the quality of the data, e.g. with respect to the coding format (for example MPEG coding), to be displayed.

In general, if moving images are to be displayed, the uniformity of the display 2 should be increased. This feature can be implemented by having the control means 11 detecting the rate of change of the data to be displayed and adjusting the duty cycle and magnitude of the driving signal in accordance with the rate of change such that uniformity is increased.

As was discussed for FIG. 1, the display 2 may have several parts 4, 5 for which a different mode with respect to uniformity of such a part 4, 5 can be selected. This can e.g. be achieved by transmitting different appropriate signals from the control means 11 over the duty cycle select line 18 to the switches T5 for the display pixels 3 constituting the parts 4 and 5. For example, part 5 may be a pop-up window showing a video on a display 2 of a computer monitor 1. Control means 11 detects the video data received over line 10 and instructs the display pixels 3 constituting the display part 5 to be driven at a lower duty cycle via duty cycle select line 18 and with a higher magnitude for the driving signal. In this way the uniformity of the part 5 is enhanced, while the remainder of the display 2 operates in a lower uniformity mode.

FIG. 6 shows a schematic illustration of a display device 7 adapted to perform the functions as described above. The control means 11 is adapted to control the duty cycle of the display 2 or the display pixels 3, e.g. via duty cycle select line 18. This duty cycle can e.g. be adjusted by a user via control button 6. As described above, the duty cycle can be varied in other ways as well, e.g. by analysing the data received over line 10. The control means 11 is adapted to adjust the magnitude of the driving signal to be sent over line 14 in accordance with the adjusted duty cycle. It is noted that while in general the product of duty cycle and current conveyed by the light emitting element may be substantially constant, it is not excluded that both the duty cycle and current through the light emitting elements are decreased or increased for certain applications.

The invention claimed is:

1. Display device comprising a display having a plurality of light emitting elements and means for applying a driving signal to said light emitting elements, wherein control means are provided adapted to adjust a duty cycle and a magnitude of said driving signal for at least one of said light emitting elements, and wherein said control means are adapted to select a single mode out of a plurality of available modes with respect to uniformity of said display or said light emitting elements.

2. Display device according to claim 1, wherein said display is an active matrix emissive display comprising light emitting diodes and said means for applying a driving signal are driving transistors, each driving transistor being associated with one of said light emitting diodes.

3. Display device according to claim 1, wherein said display device comprises selection means, such as a switch, dial or menu facility, for selecting one of said available modes by a user of said display device.

4. Display device according to claim 1, wherein said single mode is selected in accordance with the available or remaining power for an electric device comprising said display device.

5. Display device according to claim 1, wherein said single mode is selected in response to data to be displayed on said display and/or received by said device.

6. Display device according to claim 5, wherein said duty cycle dynamically adjusts an average driving signal for said display.

7. Display device according to claim 5, wherein said single mode is selected in accordance with the rate of change of data to be displayed on said display.

8. Display device according to claim 1, wherein said control means are adapted to select at least a first mode of said available modes for a first part of said display and a second mode of said available modes for a second part of said display.

9. Electric device comprising a display device according to claim 1.

10. Method for driving a display by a driving signal, said display having a plurality of light emitting elements, comprising adjusting a duty cycle and magnitude of said driving signal in accordance with each other for at least one of said light emitting elements, and selecting a single mode out of a plurality of available modes with respect to uniformity of said display or said light emitting elements.

11. The method of claim 10, further comprising:

selecting the single mode in accordance with the available or remaining Power for an electric device comprising said display device.

12. The method of claim 10, further comprising:

selecting the single mode in response to data to be displayed on said display and/or received by said device.

13. The method of claim 12, further comprising:

selecting the single mode in accordance with the rate of change of data to be displayed on said display.

* * * * *